US009583873B2

(12) United States Patent
Wang et al.

(10) Patent No.: US 9,583,873 B2
(45) Date of Patent: Feb. 28, 2017

(54) ELECTRICAL CONNECTOR HAVING DETECTING STRUCTURE

(71) Applicant: FOXCONN INTERCONNECT TECHNOLOGY LIMITED, Grand Cayman (KY)

(72) Inventors: Xiao Wang, Kunshan (CN); Shu-Jian Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 11 days.

(21) Appl. No.: 14/742,601

(22) Filed: Jun. 17, 2015

(65) Prior Publication Data

US 2015/0364864 A1 Dec. 17, 2015

(30) Foreign Application Priority Data

Jun. 17, 2014 (CN) ..... 2014 1 0269053

(51) Int. Cl.

| | |
|---|---|
| ***H01R 13/6582*** | (2011.01) |
| ***H01R 13/629*** | (2006.01) |
| ***H01R 13/703*** | (2006.01) |
| *H01R 24/60* | (2011.01) |
| *H01R 107/00* | (2006.01) |
| *H01R 13/6583* | (2011.01) |

(52) U.S. Cl.

CPC ..... *H01R 13/629* (2013.01); *H01R 13/703* (2013.01); *H01R 13/6583* (2013.01); *H01R 24/60* (2013.01); *H01R 2107/00* (2013.01)

(58) Field of Classification Search

CPC .. H01R 13/7031; H01R 13/70; H01R 13/658; H01R 13/6581; H01R 13/6582; H01R 13/6594

See application file for complete search history.

(56) References Cited

U.S. PATENT DOCUMENTS

| | | | | |
|---|---|---|---|---|
| 5,772,466 | A * | 6/1998 | Morin | H01R 24/62 439/489 |
| 6,575,775 | B2 * | 6/2003 | Hasegawa | H01R 13/41 439/188 |
| 7,241,157 | B2 * | 7/2007 | Zhuang | H01R 13/7035 439/188 |
| 8,535,087 | B1 * | 9/2013 | McKee | H01R 13/7031 439/489 |

(Continued)

FOREIGN PATENT DOCUMENTS

| | | |
|---|---|---|
| TW | M391737 | 11/2010 |
| TW | M403135 | 5/2011 |

*Primary Examiner* — Gary Paumen

(74) *Attorney, Agent, or Firm* — Wei Te Chung; Ming Chieh Chang

(57) ABSTRACT

An electrical connector includes an insulating housing, a plurality of conductive terminals received in the insulating housing, a detecting contact and a metallic shell shielding around the insulating housing. The insulating housing has a base portion and a mating tongue extending forwardly from the base portion. The metallic shell surrounds the meting tongue to form a receiving cavity opening forwardly. The conductive terminals have contacting sections exposed in the receiving cavity. The metallic shell has a resilient contacting portion contacting or disconnecting with the detecting contact so as to obtain detecting function.

20 Claims, 14 Drawing Sheets

(56) References Cited

U.S. PATENT DOCUMENTS

| | | | | |
|---|---|---|---|---|
| 8,747,147 | B2 * | 6/2014 | Yu | H01R 13/7031 439/108 |
| 8,882,540 | B2 * | 11/2014 | Yen | H01R 27/00 439/489 |
| 2014/0302708 | A1 * | 10/2014 | MacDougall | H01R 13/641 439/488 |

* cited by examiner

ELECTRICAL CONNECTOR HAVING DETECTING STRUCTURE

BACKGROUND OF THE INVENTION

1 . Field of the Invention

The present invention generally relates to an electrical connector, and more particularly to an electrical connector having detecting structure secured therein.

2 . Description of Related Art

TW patent issued NO. M391737 discloses an electrical connector, the electrical connector comprises an insulating housing, a plurality of conductive terminals received in the insulating housing and a metallic shell surrounding the insulating housing. The metallic shell surrounds the insulating housing to form a mating cavity opening forwardly. The insulating housing has a base portion and a mating tongue extending into the mating cavity from the base portion. One of the conductive terminals is defined as a detecting contact. The detecting contact has a soldering portion and an elastic contacting portion opposite to the soldering portion. The elastic contacting portion of the detecting contact extends into the mating cavity. In use, the detecting contact will be frequently pressed outwardly by the complementary connector, thereby the detecting contact is easy to be destroyed.

Therefore, an electrical connector having new detecting structure is provided to overcome the drawbacks described aforementioned would be desirable.

SUMMARY OF THE INVENTION

Accordingly, an object of the present invention is to provide an electrical connector having improved detecting structure.

In order to achieve the object set forth, an electrical connector comprises an insulating housing, a plurality of conductive terminals received in the insulating housing, a detecting contact and a metallic shell shielding around the insulating housing. The insulating housing has a base portion and a mating tongue extending forwardly from the base portion. The metallic shell surrounds the meting tongue to form a receiving cavity opening forwardly. The conductive terminals have contacting sections exposed in the receiving cavity. The metallic shell has a resilient contacting portion contacting or disconnecting with the detecting contact so as to obtain detecting function.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

The present invention provides an electrical connector having an improved detecting structure, the electrical connector may selectively to mate with a HDMI plug connector or a Displayport plug connector. The detecting structure can detect the type of the complementary connector.

FIG. 1 to FIG. 10 show an electrical connector of a first preferred embodiment of the present invention in detail hereinafter.

Figure 1:
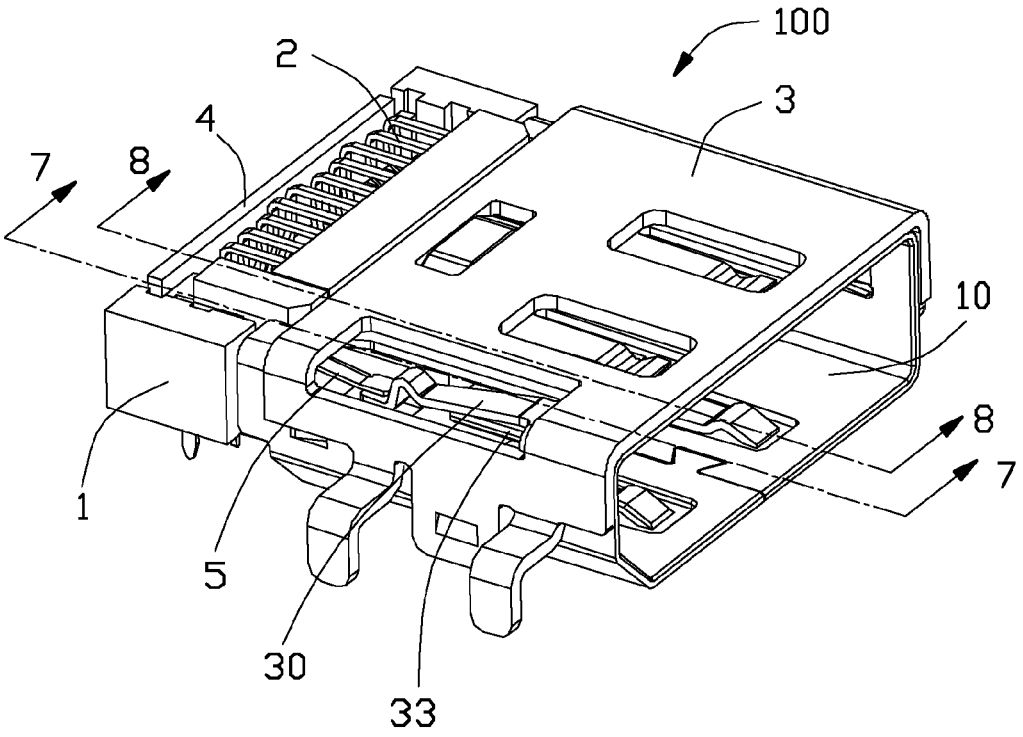
FIG. 1 is a perspective view of an electrical connector in a first embodiment of the present invention.
Figure 2:
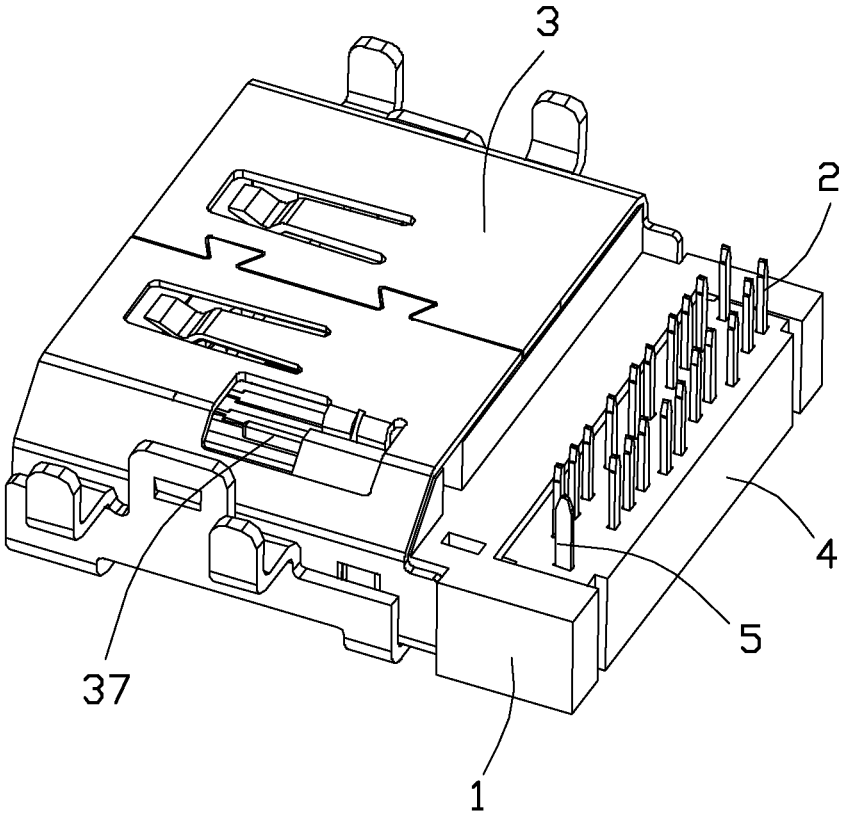
FIG. 2 is another perspective view of the electrical connector shown in FIG. 1.

Referring to FIG. 1 and FIG. 2, the electrical connector 100 has an insulating housing 1, a plurality of conductive terminals 2 received in the insulating housing 1, a detecting contact 5 and a metallic shell 3 shielding around the insulating housing 1. A retaining spacer 4 is disposed behind the insulating housing 1 and used to retain connecting legs of the conductive terminals 2 and the detecting contact 5. The metallic shell 3 has an elastic contacting portion 30 contacting/disconnecting with the detecting contact 5 so as to obtain detecting function and an opening 33 facing to the elastic contacting portion 30. The elastic contacting portion 30 is separated with the detecting contact 5 before the complementary connector (not labeled) mating with the electrical connector 100. When the complementary connector is inserted into the electrical connector 100, the elastic contacting portion 30 is pressed upwardly to contact with the detecting contact 5 by a shell of the complementary connector.

Figure 3:
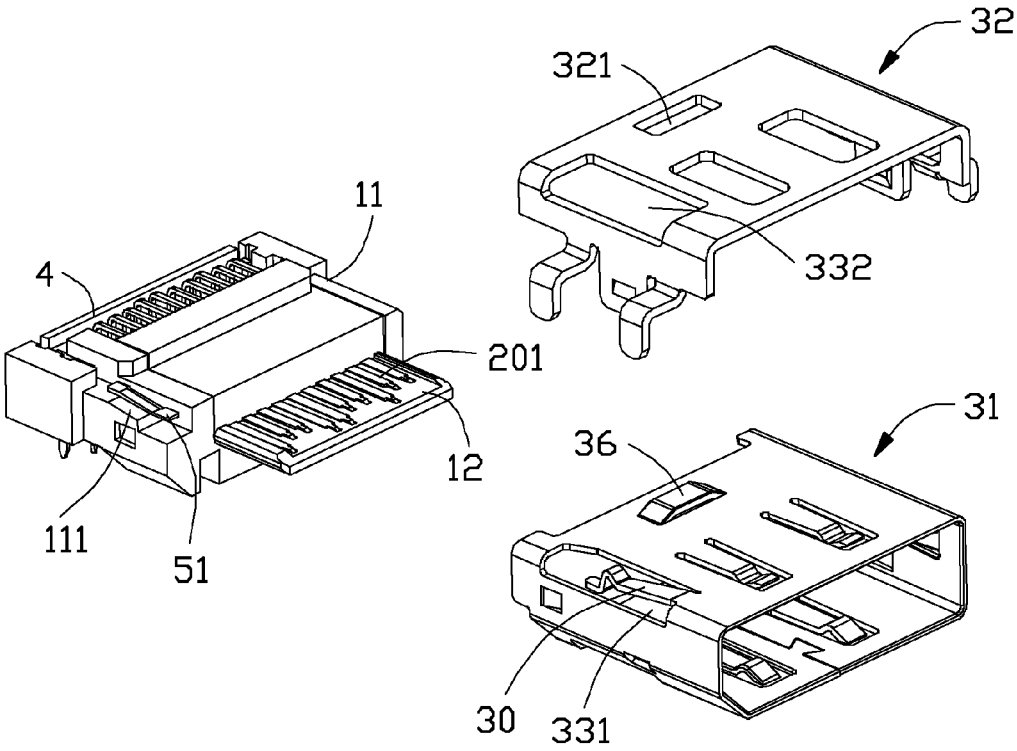
FIG. 3 is a part exploded perspective view of the electrical connector shown in FIG. 1.
Figure 4:
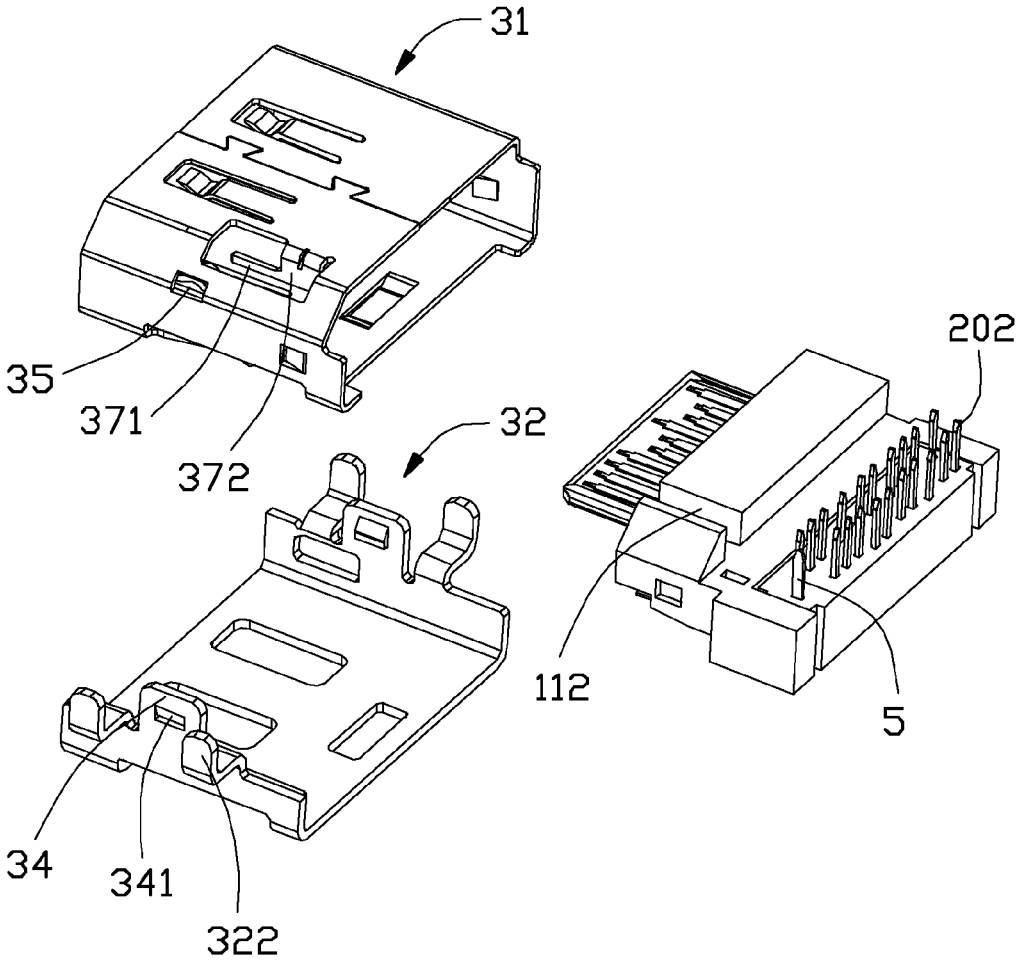
FIG. 4 is another exploded perspective view of the electrical connector shown in FIG. 3.

Referring to FIG. 3 and FIG. 4, the insulating housing 1 has a base portion 11 and a mating tongue 12 extending forwardly from the base portion 11. Combined with FIG. 1, the metallic shell 3 surrounds the mating tongue 12 to form a receiving cavity 10 opening forwardly. The conductive terminals 2 have contacting portions 201 exposed in the receiving cavity 10 and soldering legs 202 extending out of the insulating housing 1. The base portion 11 of the insulating housing 1 has an accommodating room 111 into which a detecting portion 51 of the detecting contact 5 extends. The detecting portion 51 of the detecting contact 5 does not extend into the receiving cavity 10. In other words, the detecting portion 51 is located behind a front face of the base portion 11. Conjoined with FIG. 7, the accommodating room 111 has a detecting room 111 communicating with the receiving cavity 10. The detecting portion 51 defines a protruding portion 5111 located in the detecting room 111 so as to abut against the elastic contacting portion 30. The metallic shell 3 has a shielding shell 31 surrounding the insulating housing 1 and a second metallic member 32 retained on the shielding shell 31. The second metallic member 32 has two opposite retaining sections 34 and four connecting legs 322 extending downwardly. The shielding shell 31 has two retaining holes 35 corresponding to the retaining sections 34. In the present invention, the retaining section 34 defines a latch member 341 latching with the retaining hole 35. The connecting legs 322 are respectively disposed at two sides of the shielding shell 31 on average along a transverse direction perpendicular to the insertion direction and used to fix the electrical connector 100 on a printed circuit board (not labeled). The shielding shell 31 has an aligned block 36, and the second metallic member 32 has an aligned hole 321 corresponding to the aligned block 36. After the second metallic member 32 is assembled and retained on the shielding shell 31 the aligned block 36 is located in the aligned hole 321. In this preferred embodiment, the elastic contacting portion 30 is stamped from the shielding shell 31. The shielding shell 31 has a first opening 331, the second metallic member 32 has a second opening 332, the elastic contacting portion 30 can move into the first and second openings 331, 332. The second opening 332 has a shape approximate as same as the first opening 331 and both of which are communicated with each other. Conjoint with FIG. 2, the electrical connector 100 has a blocking portion 37 adjacent to the base portion 11 of the insulating housing 1 and projecting into the receiving cavity 10. The blocking portion 37 and the metallic shell 3 are separately made as two pieces or stamped from one metal plate as one piece. The base portion 11 has an abdicating room 112 for receiving the blocking portion 37, the blocking portion 37 hangs in the abdicating room 112 and is movable therein. The blocking portion 37 has a connecting section 372 connecting with the metallic shell 3 and a protruding section 371 extending into the receiving cavity 10. In this preferred embodiment, the connecting section 372 connects with the shielding shell 31 and is accommodated in the abdicating room 112, the protruding section 371 is partly accommodated in the abdicating room 112 and further extends into the receiving cavity 10. The blocking portion 37 is stamped from the shielding shell 31, and the shielding shell 31 has a notch (not labeled) through which the blocking portion 37 runs into the receiving cavity 10.

Figure 5:
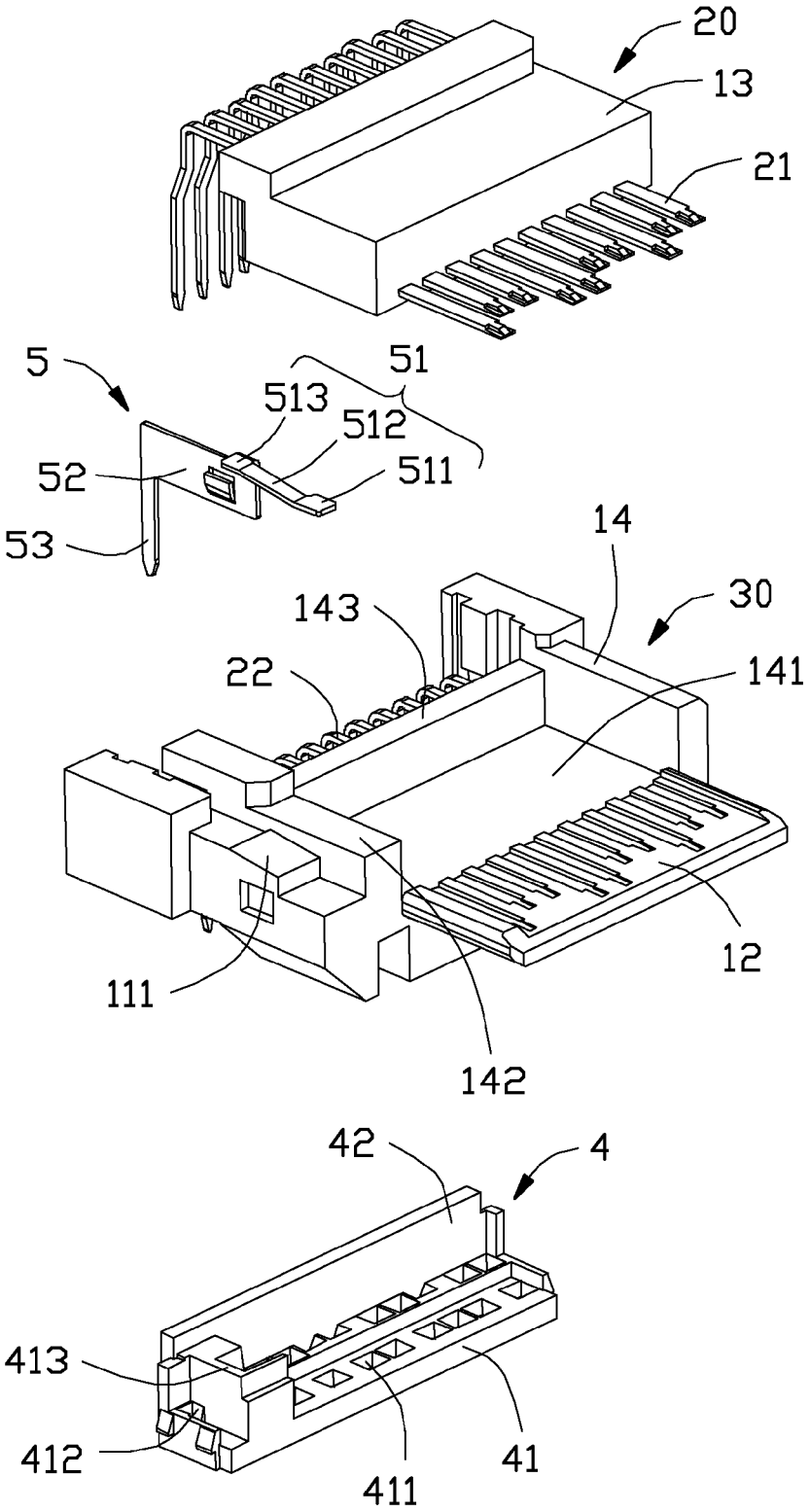
FIG. 5 is a part exploded perspective view of the electrical connector shown in FIG. 1, with the metallic shell removed.
Figure 6:
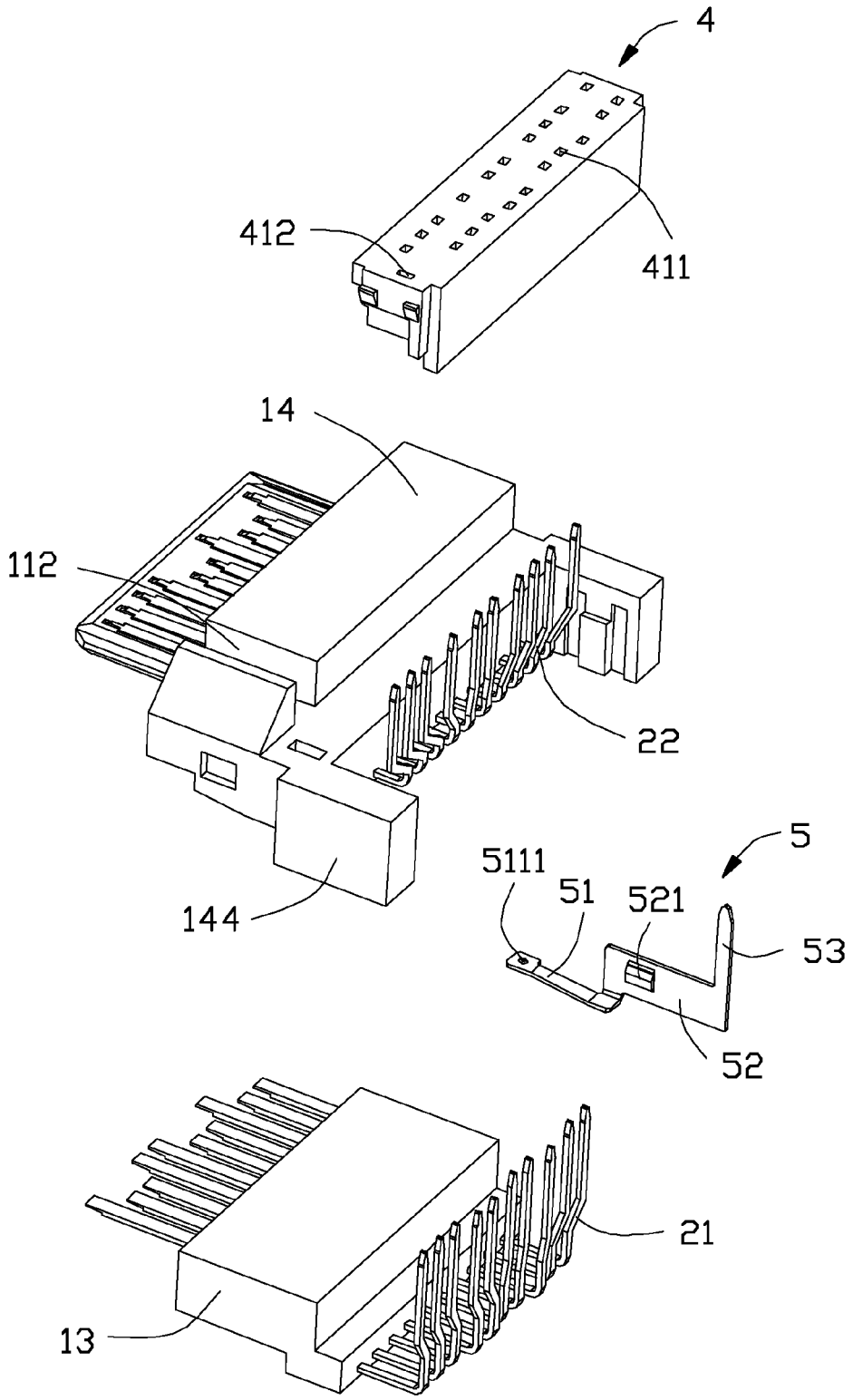
FIG. 6 is another perspective view of the electrical connector shown in FIG. 5.

Referring to FIG. 5 and FIG. 6, the insulating housing 1 has a first insulator 13 and a second insulator 14 assembled with each other. The second insulator 14 forms the base portion 11 and the mating tongue 12 aforementioned. The conductive terminals 2 comprise a plurality of first terminals 21 embedded in the first insulator 13 and a plurality of second terminals 22 embedded in the second insulator 14. The first terminals 21 are insert molded in the first insulator 13 to form a first terminal module 20, the second terminals 22 are insert molded in the second insulator 14 to form a second terminal module 40, and both of the two modules are assembled with each other. The first terminal module 20 is downwardly assembled and fixed on the second terminal module 40. The second insulator 14 has two opposite side walls 142 and a rear wall 143 connecting with the two side walls 142. The two side walls 142 and the rear wall 143 are common to form a retaining room 141 for receiving the first insulator 13. Said accommodating room 111 and said retaining room 141 are disposed at two sides of one said side wall 142. Each of the side walls 142 rearwardly extends to form a retaining block 144, and the two retaining blocks 144 are opposite to each other. Said two retaining blocks 144 are respectively disposed at two sides of the connecting legs 202 of the conductive terminals 2 to fix said retaining spacer 4. The retaining spacer 4 is roughly configured as L-shaped. The retaining spacer 4 has a main body 41 retaining the connecting legs 202 and a rear cover 42 perpendicular to the main body 41. The main body 41 of the retaining spacer 4 defines a plurality of first retaining holes 411 through which said connecting legs 202 run and a second retaining hole 412 through which the detecting contact 5 runs. The retaining spacer 4 further defines a subsidiary side wall 413 connecting the main body 41 and the rear cover 42. The first retaining holes 411 are located at one side of the subsidiary side wall 413 and the second retaining hole 412 is located at the other side of the subsidiary side wall 413. The subsidiary side wall 143 is aligned with the corresponding side wall 142 along a front-to-back direction.

Figure 7:
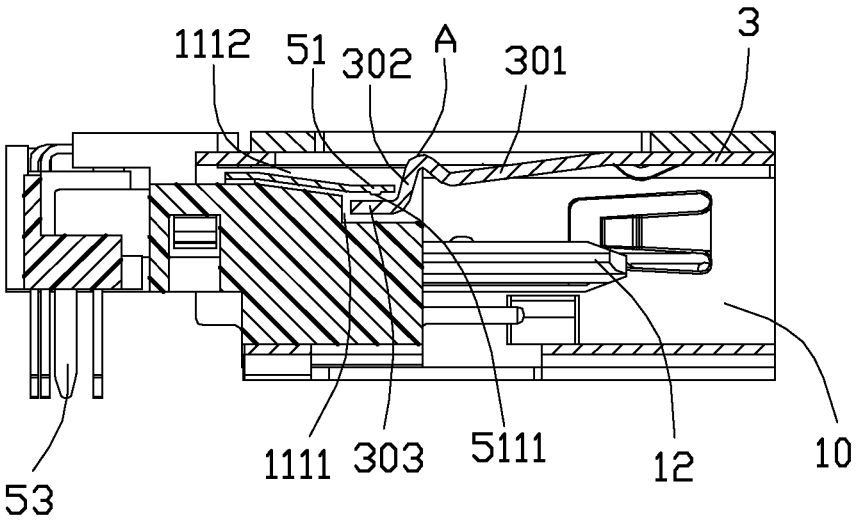
FIG. 7 is a cross-sectional perspective view of the electrical connector along line 7-7 shown in FIG. 1.

Combined with FIG. 7, the detecting structure of the present embodiment will be described in detail hereinafter. The detecting structure defines a detecting contact 5 and an elastic contacting portion 30 extending from the metallic shell 3. The second insulator 14 defines said accommodating room 111. The accommodating room 111 is roughly configured as L-shaped and has said detecting room 1111 and a movable room communicating with said detecting room 1111. The movable room 1112 rearwardly runs through a rear face of the base portion 11. The detecting contact 5 has a retaining portion 52 perpendicular to said detecting portion 51 and a connecting portion 53 extending out of the retaining spacer 4. The retaining portion 52 has a latching portion 521 latching with the insulating housing 1. The latching portion 521 is stamped from the detecting contact 5. The detecting portion 51 of the detecting contact 5 has a connecting segment 513 connecting with said retaining portion 52, a detecting segment 511 extending into the detecting room 1111 and an inclined segment 512 connecting the connecting segment 513 with the detecting segment 511. The connecting segment 513 is parallel to the detecting segment 511. Said protruding portion 5111 is disposed on the bottom of the detecting segment 511. The connecting segment 513 and the inclined segment 512 are located in the movable room 1112. The elastic contacting portion 30 has a resilient arm 301 connecting with the metallic shell 3, a bending segment 302 rearwardly extending from the resilient arm 301 and a contacting segment 303 located behind the bending segment 302. The detecting portion 51 of the detecting contact 5 is disposed above the contacting segment 303 of the elastic contacting portion 30, the bending segment 302 is located in front of the detecting portion 51. The height of the junction of the bending segment 302 and the resilient arm 301 is higher than that of the bending segment and the contacting segment 303. The bending segment 302 has a highest point A between the resilient arm 301 and the contacting segment 303. In use, the highest point A may be higher than an upper outer surface of the metallic shell 3. However, in this preferred embodiment, the highest point A is not higher than the upper surface of the metallic shell 3 no matter when the contacting segment 303 mechanically and electrically contacts with the detecting portion 51.

Figure 8:
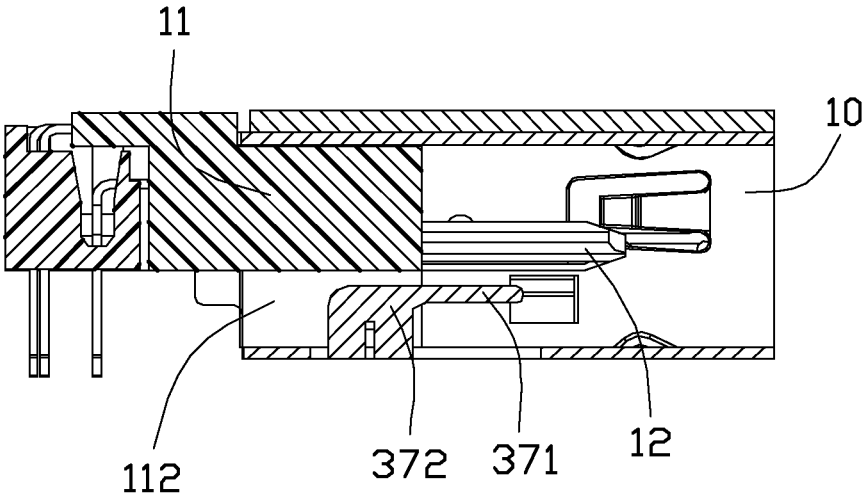
FIG. 8 is a cross-sectional perspective view of the electrical connector along line 8-8 shown in FIG. 1.
Figure 9:
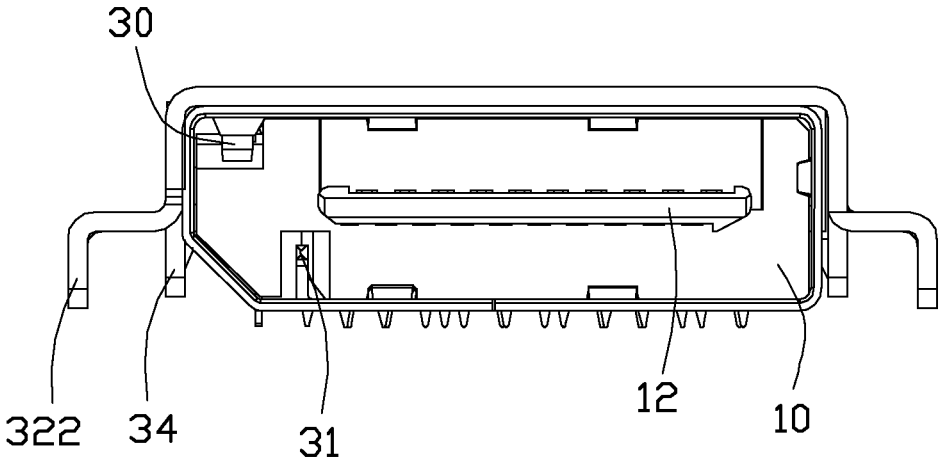
FIG. 9 is a front view of the electrical connector shown in FIG. 1.

Referring to FIG. 8 and FIG. 9, the blocking portion 37 is disposed at one side of the mating tongue 12 and spaced from the mating tongue 12. The connecting section 372 of the blocking portion 37 is received in the abdicating room 112 and behind a front face of the base portion 11. The blocking portion 37 and the elastic contacting portion 30 are staggered along a vertical and longitudinal direction perpendicular to the front-to-back direction. The connecting legs 322 of the metallic shell 3 are disposed at two sides of the retaining sections 34.

Figure 10:
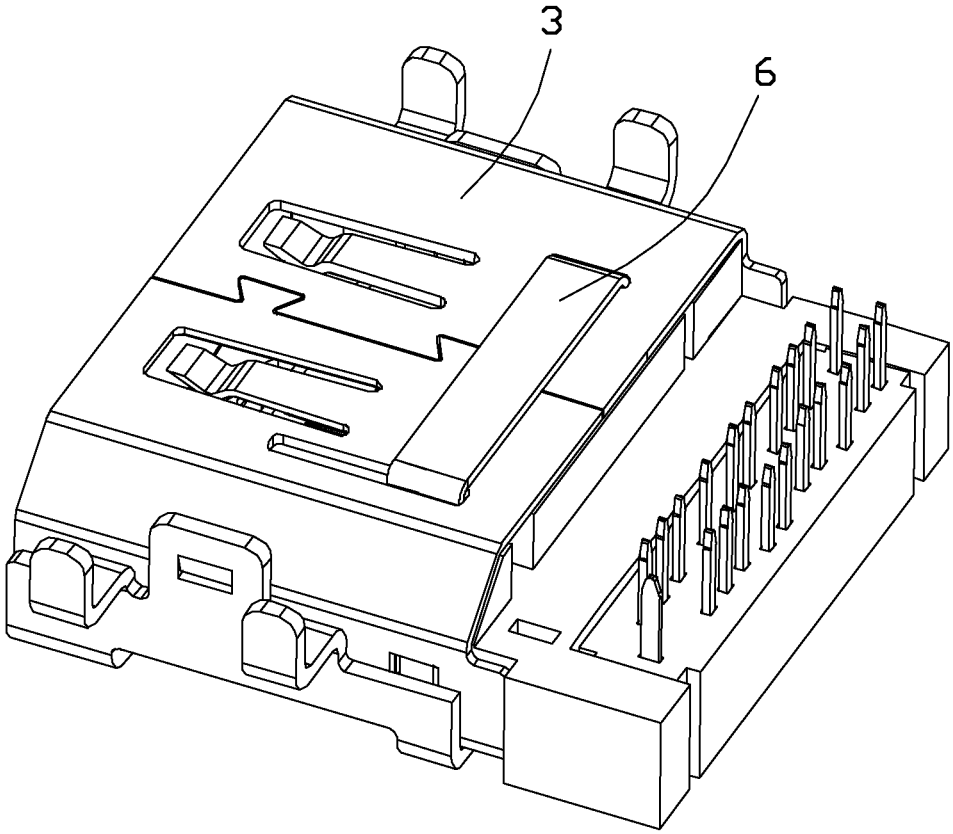
FIG. 10 is a perspective view of the electrical connector shown in FIG. 1 having a first metallic member.
Figure 11:
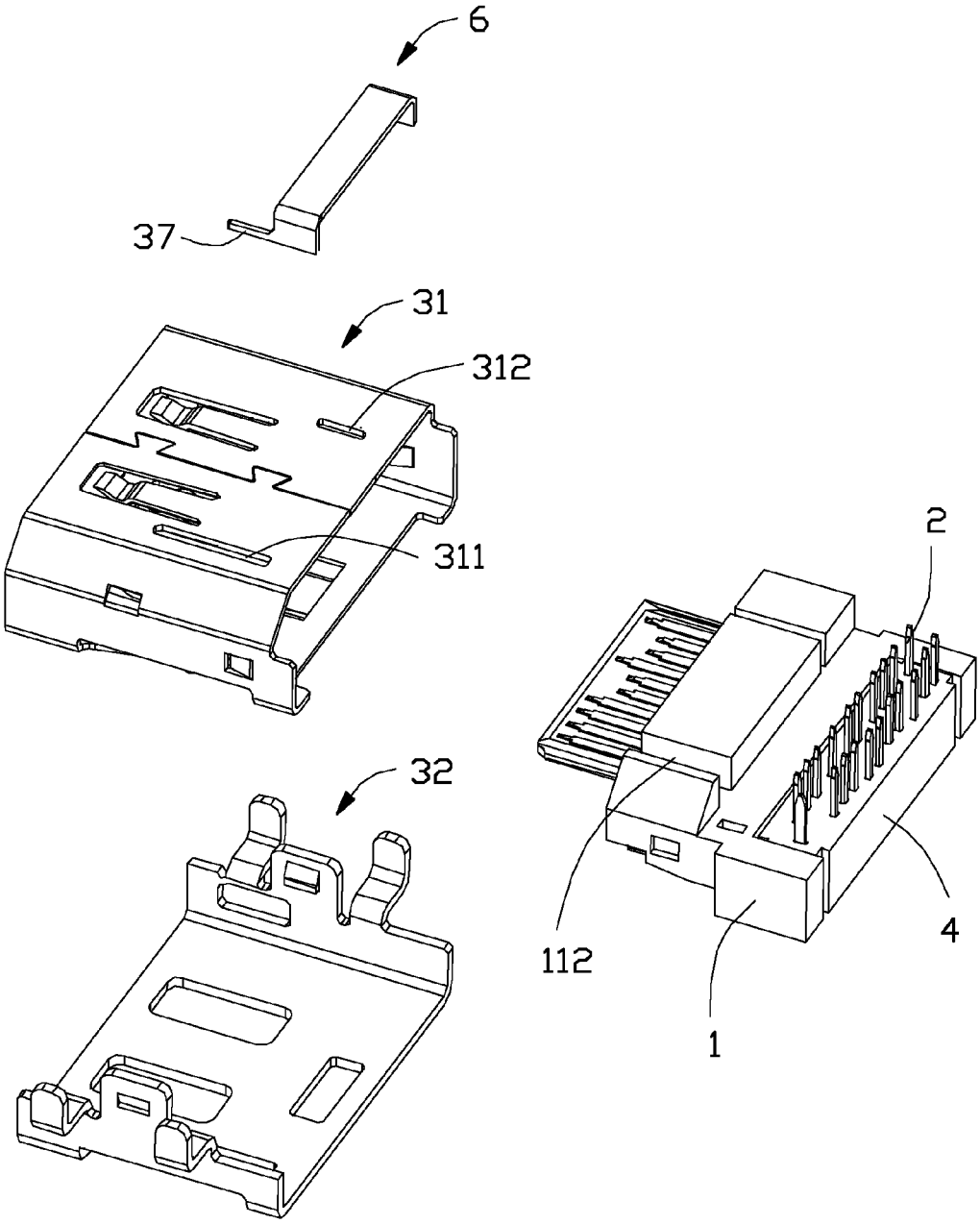
FIG. 11 is an exploded perspective view of the electrical connector shown in FIG. 10.

Referring to FIG. 10 and FIG. 11, the blocking portion 37 may extend from a first metallic member 6. The first metallic member 6 is retained on the shielding shell 31. The shielding shell 31 defines a first retaining hole 311 and a second retaining hole 312 for retaining the first metallic member 6. The blocking portion 37 extends through the first retaining hole 311 into the receiving cavity 10.

Figure 12:
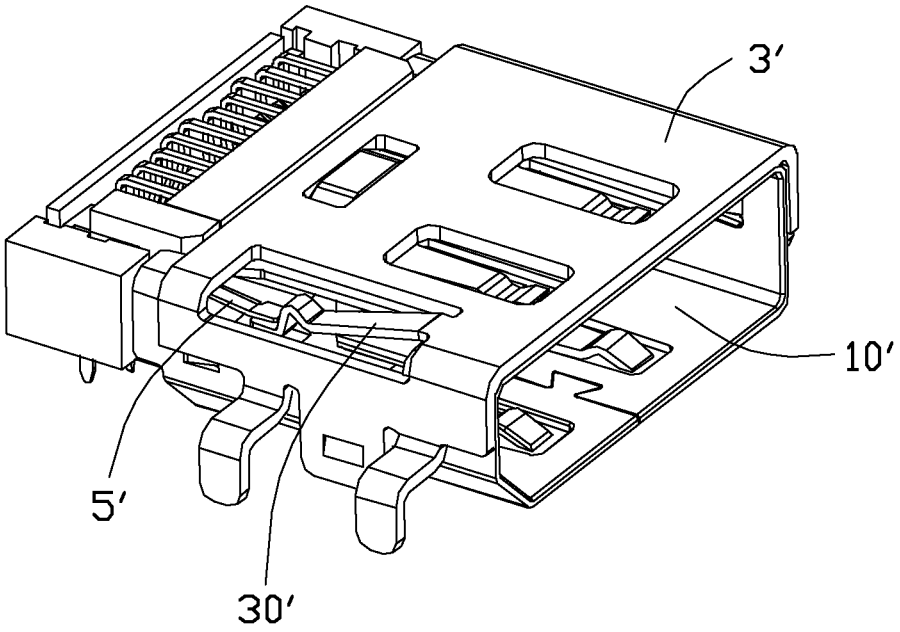
FIG. 12 is a perspective view of an electrical connector in a second embodiment of the present invention.
Figure 13:
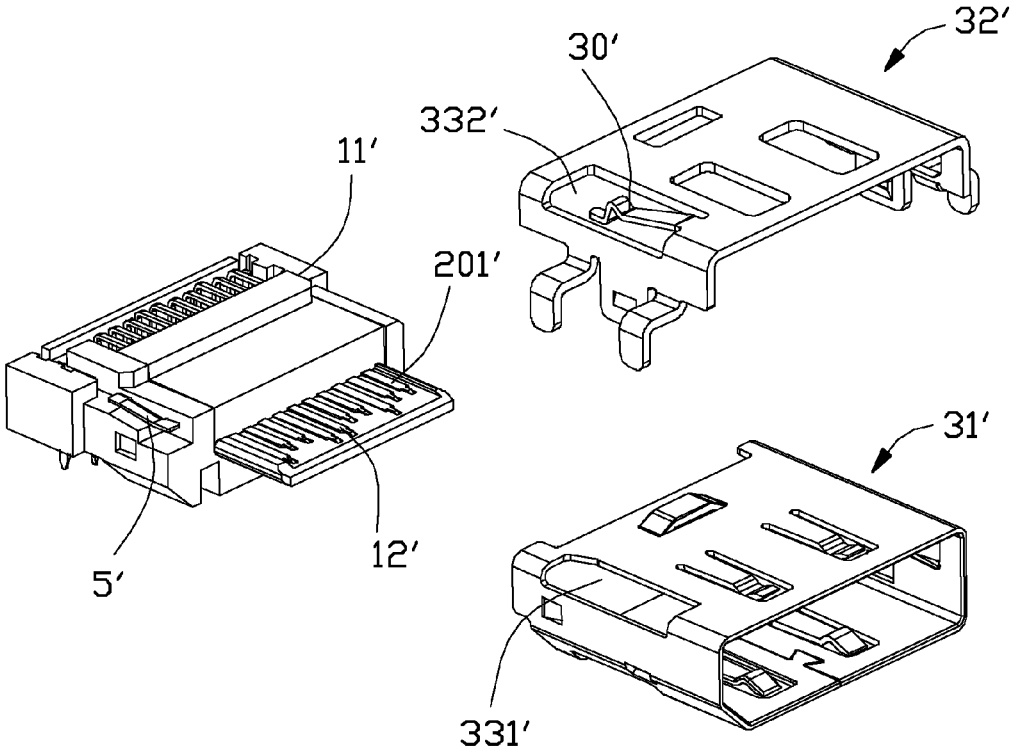
FIG. 13 is an exploded perspective view of the electrical connector in FIG. 12.

FIG. 12 and FIG. 13 are taken to describe an electrical connector of a second preferred embodiment of the present invention in detail hereinafter. The structure of the electrical connector of the second embodiment is roughly the same as that of the first embodiment. The same structure will be labeled with the same label and not be described in detail again in this preferred embodiment.

Compared to the electrical connector of the first embodiment, the elastic contacting portion 30' of this embodiment extends from a second metallic member 32'. The elastic contacting portion 30' is stamped from the second metallic member and inwardly extends through the first and second opening 331', 332' for contacting with the detecting contact 5'.

Figure 14:
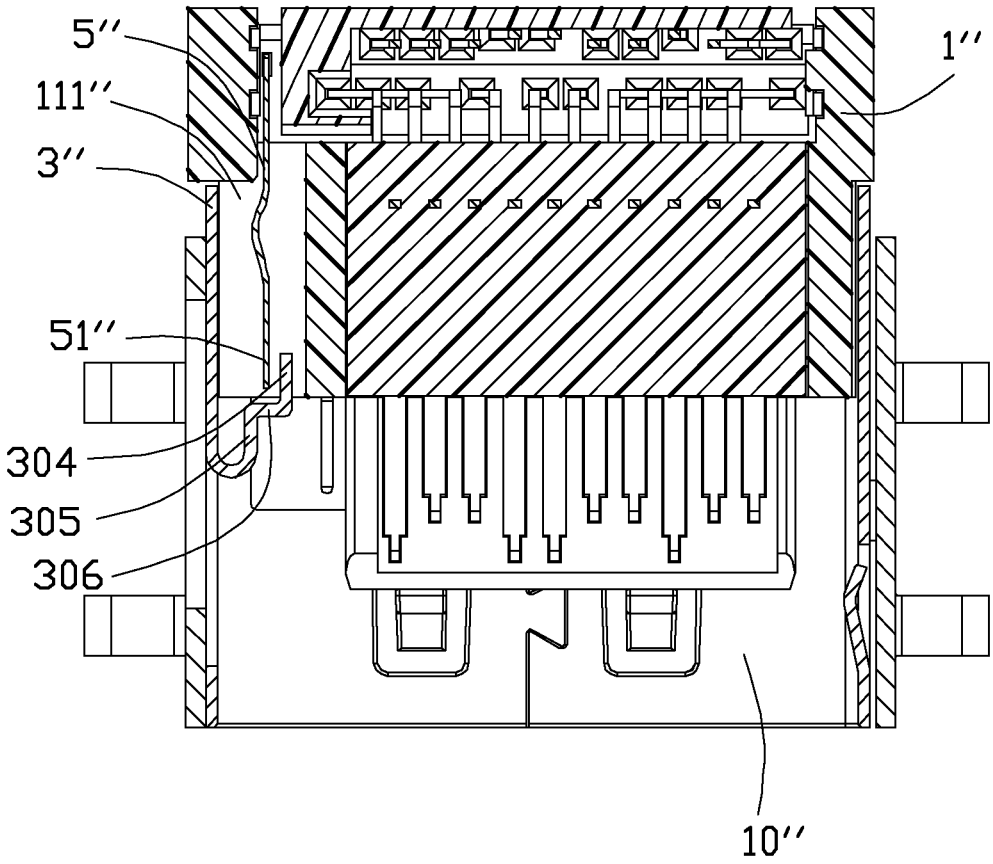
FIG. 14 is a perspective view of an electrical connector in a third embodiment of the present invention.

FIG. 14 is taken to describe an electrical connector of a third preferred embodiment of the present invention in detail hereinafter. The structure of the electrical connector of the third embodiment is roughly the same as that of the first embodiment. The same structure will be labeled with the same label and not be described in detail again in this preferred embodiment.

An elastic contacting portion 30" bends and extends from one side of a metallic shell 3". The elastic contacting portion 30" may be stamped initially from the metallic shell 3" and then bended or directly tore from the metallic shell 3". The insulating housing 1" has an accommodating room 111" at one side thereof. The accommodating room 111" is provided as a detecting space and receives the elastic contacting portion 30' and a detecting contact 5". The elastic contacting portion 30" has a contacting segment 304, a resilient segment 305 disposed between the contacting segment 304 and the metallic shell 3" and a pulling segment 306 connecting the contacting segment 304 with the resilient segment 305. A detecting portion 51" of the detecting contact 5" is located between the contacting segment 304 and the metallic shell 3" along a longitudinal direction perpendicular to a front-to-back direction and behind the pulling segment 306 along a front-to-back direction. When a complementary connector is inserted, a shell of the complementary connector presses on the resilient segment 305 so as to make the contacting segment 304 outwardly move to mechanically and electrically contact with the detecting contact 5". When the complementary connector is pulled off the electrical connector, the contacting segment 304 of the elastic contacting portion 30" moves to the original position. In other embodiments, the shell of the complementary connector may presses on the contacting segment 304 of the elastic contacting portion 30" when the two connectors mated with each other.

Apart from the three preferred embodiments described aforementioned, in other embodiment, the detecting structure may have other design such as follows: a resilient contacting portion is in contact with a detecting contact before a complementary connector inserted, and when the two connectors mate with each other, the resilient contacting portion is separated with the detecting contact.

In conclusion, the detecting contact 5, 5',5" is received in the accommodating room 111, 111', 111" and does not protrude into the receiving cavity 10, 10', 10", thereby the detecting contact 5, 5', 5" is not easy to be destroyed due to the protection of the insulating housing 1, 1', 1".

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulating housing having a base portion and a mating tongue extending forwardly from the base portion;

a metallic shell shielding around the insulating housing, the metallic shell surrounding the mating tongue to form a receiving cavity opening forwardly;

a plurality of conductive terminals received in the insulating housing, the conductive terminals having contacting sections exposed in the receiving cavity; and a detecting contact retained in the base portion of the insulating housing;

wherein the metallic shell has a resilient contacting portion provided for contacting or disconnecting with the detecting contact so as to obtain a detecting function.

2. The electrical connector as claimed in claim 1, wherein the base portion of the insulating housing defines an accommodating room, the detecting contact has a detecting portion extending into the accommodating room and does not protrude into the receiving cavity.

3. The electrical connector as claimed in claim 2, wherein the accommodating room is roughly configured as L-shaped and has a detecting room communicating with the receiving cavity, the detecting portion has a protruding portion located in the detecting cavity and being used for contacting with the resilient contacting portion.

4. The electrical connector as claimed in claim 3, wherein the detecting contact has a retaining portion retained in the insulating housing, the detecting portion has a connecting segment connecting with the retaining portion, a detecting segment extending into the detecting room and an inclined segment connecting the connecting segment with the detecting segment, the connecting segment is parallel to the detecting segment, the protruding portion is disposed on the bottom of the detecting segment.

5. The electrical connector as claimed in claim 3, wherein the detecting contact has a retaining portion perpendicular to the detecting portion and a connecting portion extending downwardly from the retaining portion and out of the insulating housing, the retaining portion and the connecting portion are in a same plane.

6. The electrical connector as claimed in claim 1, wherein the resilient contacting portion has a resilient arm, a bending segment bending and extending rearwardly from the resilient arm and a contacting segment located behind the bending segment, the detecting contact has a detecting portion disposed above the contacting segment.

7. The electrical connector as claimed in claim 6, wherein the bending segment is disposed in front of the detecting portion, the height of the junction of the bending segment and the resilient arm is higher than that of the bending segment and the contacting segment, the bending portion has a highest point between the resilient arm and the contacting segment, the highest point is not higher than an upper surface of the metallic shell when the contacting segment mechanically and electrically contacts with the detecting portion.

8. The electrical connector as claimed in claim 2, wherein the resilient contacting portion bends from one side of the metallic shell, the resilient contacting portion has a contacting segment, a resilient segment disposed between the contacting segment and the metallic shell and a pulling segment connecting the contacting segment and the resilient segment, the detecting portion is located between the contacting segment and the metallic shell and behind the pulling segment.

9. The electrical connector as claimed in claim 1, further comprising a blocking portion extending into the receiving cavity from an area adjacent to the base portion, the blocking portion is disposed at one side of the mating tongue and spaced apart therefrom, the blocking portion and the resilient contacting portion are staggered along a vertical and transverse direction taken from the front view.

10. The electrical connector as claimed in claim 9, further comprising a first metallic member retained on the metallic shell, the blocking portion extends from the first metallic member.

11. The electrical connector as claimed in claim 1, wherein the metallic shell has a second metallic member having the resilient contacting portion aforementioned extending inwardly, the second metallic member has connecting legs fixed on a printed circuit board.

12. An electrical connector comprising:

an insulating housing having a base portion and a mating portion extending forwardly from a front face of the base portion;

a metallic shell surrounding the mating portion to form a mating cavity and including a resilient contacting portion;

a plurality of conductive terminals retained in the insulating housing and having contacting sections exposed in the mating cavity; and a detecting structure defining a detecting contact retained in the housing and said resilient contacting portion extending towards the detecting contact to overlap with the detecting contact;

wherein the metallic shell has a plurality of side walls with front parts forming the mating cavity, and the detecting contact is surrounded by the side walls.

13. The electrical connector as claimed in claim 12, wherein the detecting contact is retained in the base portion and provides a detecting portion extending in the base portion which does not protrude beyond the front face of the base portion.

14. The electrical connector as claimed in claim 12, wherein the base portion has an accommodating room, a free end of the detecting contact and a free end of the resilient contacting portion are both movable in the accommodating room.

15. The electrical connector as claimed in claim 14, wherein the free end of the resilient contacting portion is separated from that of the detecting contact before a complementary connector is inserted, when the two connectors mate with each other the end of the resilient contacting portion contacts with that of the detecting contact.

16. The electrical connector as claimed in claim 14, wherein the free end of the resilient contacting portion contacts with that of the detecting contact before a complementary connector is inserted, when the two connectors mate with each other the two ends of the resilient contacting portion and the detecting contact are separated with each other.

17. An electrical connector comprising:

an insulative housing;

a plurality of contacts disposed in the housing;

a metallic shell enclosing said housing to define a mating cavity therein for receiving a plug therein;

a detecting contact disposed in the housing and hidden behind the mating cavity in a front-to-back direction; and a resilient contacting portion unitarily extending from the shell; wherein said resilient contacting portion includes a first section extending into the mating cavity and adapted to be deflected by said plug, and a second section extending rearward beyond the mating cavity and confronting the detecting contact between connecting and disconnecting positions in response to deflection of said first section.

18. The electrical connector as claimed in claim 17, wherein said first section is deflectable in a transverse direction perpendicular to said front-to-back direction.

19. The electrical connector as claimed in claim 17, wherein said second section is connected with the detecting contact when the first section is deflected by the plug, and is disconnected from the detecting contact when the first section is not deflected by the plug.

20. The electrical connector as claimed in claim 17, wherein said housing includes a base behind the mating cavity, and a mating tongue forwardly unitarily extending from the base into the mating cavity.

* * * * *